United States Patent [19]

Farge

[11] 4,102,091

[45] Jul. 25, 1978

[54] PREFABRICATED BUILDINGS

[75] Inventor: Hervé Farge, Maurepas, France

[73] Assignee: Societe Anonyme dite: S I C O F, France

[21] Appl. No.: 745,667

[22] Filed: Nov. 29, 1976

[30] Foreign Application Priority Data

Dec. 1, 1975 [FR] France ..... 75 36663

[51] Int. Cl.[2] ..... E04H 1/12

[52] U.S. Cl. ..... 52/79.7; 52/220; 52/262; 52/264; 52/615

[58] Field of Search ..... 52/79.1–79.5, 52/79.7–79.9, 79.12–79.14, 264, 220, 615, 262, 650, 263, 16, 221, 185, 187, 601, 602

[56] References Cited

U.S. PATENT DOCUMENTS

| | | | |
|---|---|---|---|
| 745,141 | 11/1903 | Bielhen | 52/187 X |
| 3,621,624 | 11/1971 | Gustafson | 52/220 X |
| 3,707,165 | 12/1972 | Stahl | 52/34 X |
| 3,927,498 | 12/1975 | Benedetti | 52/79.1 |
| 3,983,673 | 10/1976 | Camus | 52/263 |

FOREIGN PATENT DOCUMENTS

| | | | |
|---|---|---|---|
| 60,129 | 9/1954 | France | 52/16 |

*Primary Examiner*—Stephen J. Novosad
*Assistant Examiner*—Carl D. Friedman
*Attorney, Agent, or Firm*—Robert E. Burns; Emmanuel J. Lobato; Bruce L. Adams

[57] ABSTRACT

A prefabricated modular building capable of being dismantled and re-used. This building has a roof and a floor, each made in one piece from molded plastic material and each having a peripheral rib, which serves as a strengthening member and as a housing for services.

7 Claims, 19 Drawing Figures

PREFABRICATED BUILDINGS

BACKGROUND OF THE INVENTION

The present invention relates to a prefabricated modular building which can be dismantled and re-used.

Buildings of this type are already known, which are used on building sites for example, to provide accommodation with sanitation, relaxation rooms, restaurant facilities as well as offices, laboratories, workshops etc. Buildings of this type known hitherto have not been designed to have a long life expectancy and generally, after they have been used several times at different locations, requiring dismantling and re-assembly operations, they are unsuitable for any further use. Furthermore, they provide little in the way of comfort and their aesthetic qualities are low.

The present invention intends to remedy these drawbacks by providing a light-weight and strong building which is economical to manufacture and may be used many times without its characteristics as regards comfort and solidity being impaired.

SUMMARY OF THE INVENTION

To this end, this prefabricated modular building of parallelepipedal shape comprising a roof, floor and vertical wall sections, as well as means for interconnecting the latter is characterised in that the roof and floor are made in a one-piece contruction from moulded plastics or mineral material and each comprise a peripheral rib serving as a strengthening member and housing for the internal pipework.

Accordng to an additonal feature of the invention, tubular connecting members are fixed by bedding in the corners of the roof and floor and these tubular members fit in metal uprights located at the corners of the building and serving to interconnect the roof and floor. The vertical wall sections extending between the roof and floor are constituted either by standardised panels or even by moulded shells.

The building according to the invention can be completely dismantled: its roof and floor form a case in which the flat panels, uprights and all the connecting members are placed for transportation of the building.

The constituent parts of the building are very strong and have a very long life expectancy owing to the fact that they are made from plastics or mineral material in a sandwich construction.

Siting the building takes place in a very simple manner: in fact, it is sufficient to provide blocks of concrete on the ground, on which the floor rests.

BRIEF DESCRIPTION OF THE DRAWINGS

Various embodiments of the present invention will be described hereafter, as non-limiting examples, with reference to the accompanying drawings in which.

DESCRIPTION OF THE PREFERRED EMBODIMENTS

Figure 1:
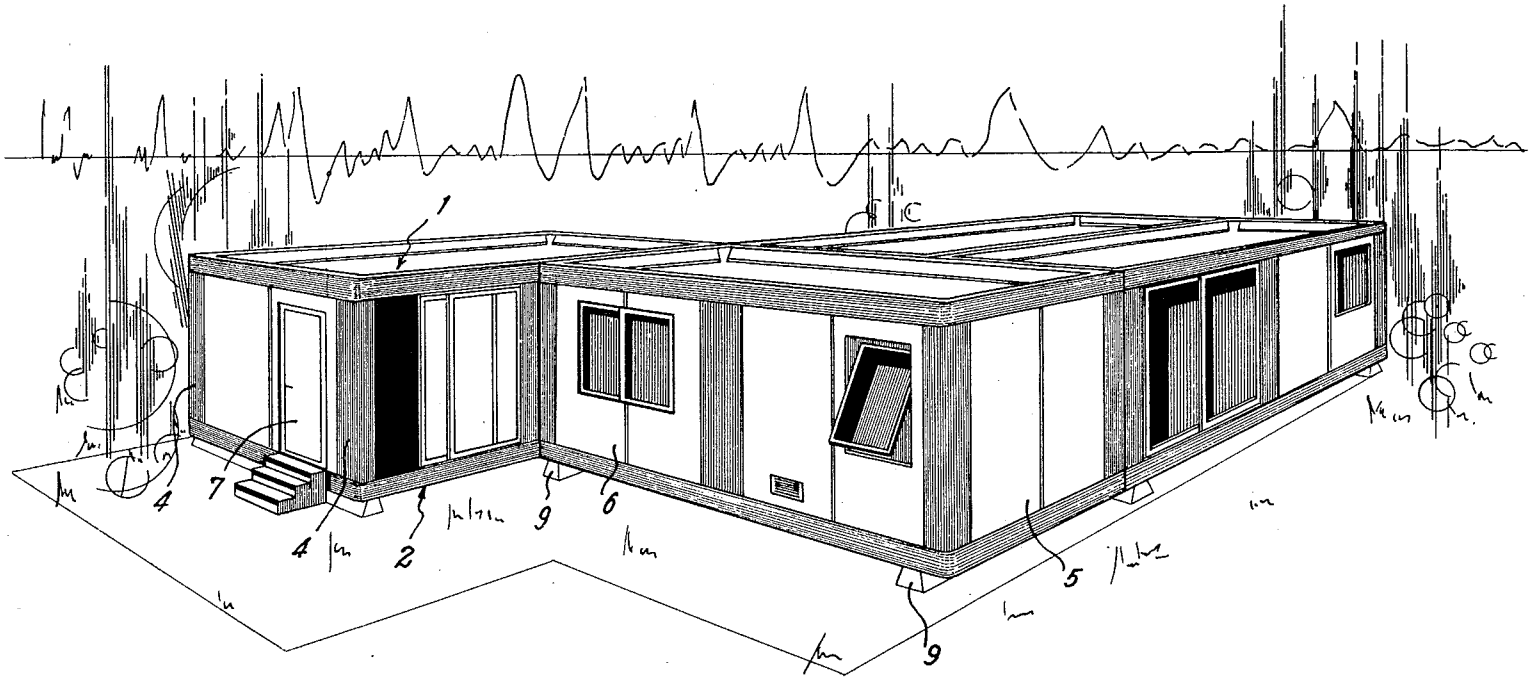
FIG. 1 is a perspective view of a construction formed by several modular buildings according to the invention, arranged on one level.
Figure 3:
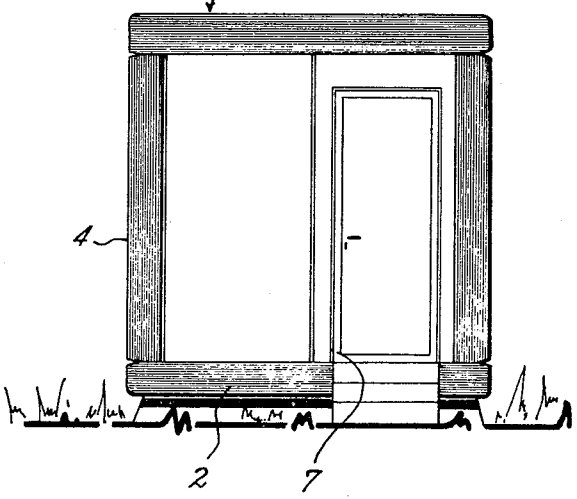
FIG. 3 is an end view of the building of FIG. 2.
Figure 2:
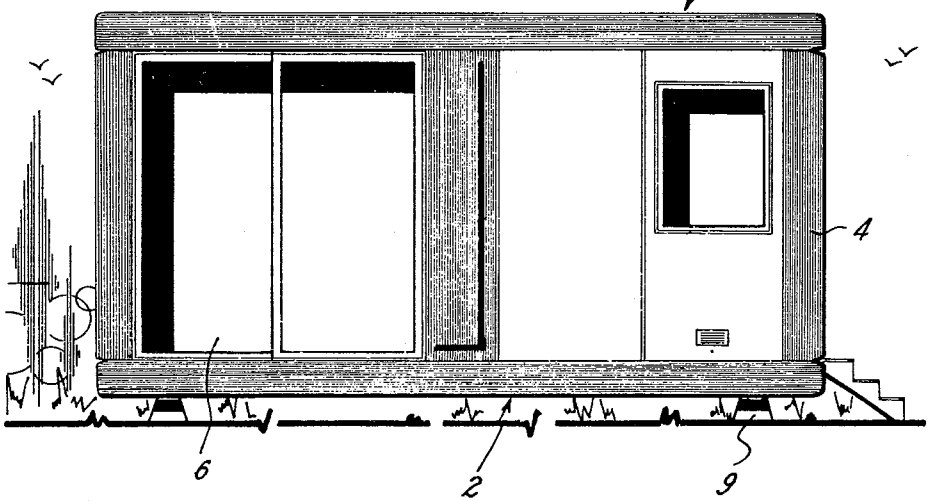
FIG. 2 is an elevational view of one of the modular buildings.
Figure 5:
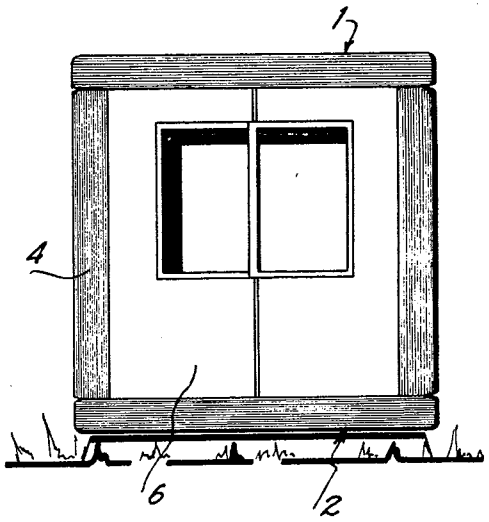
FIG. 5 is an end view of the building according to FIG. 4.
Figure 4:
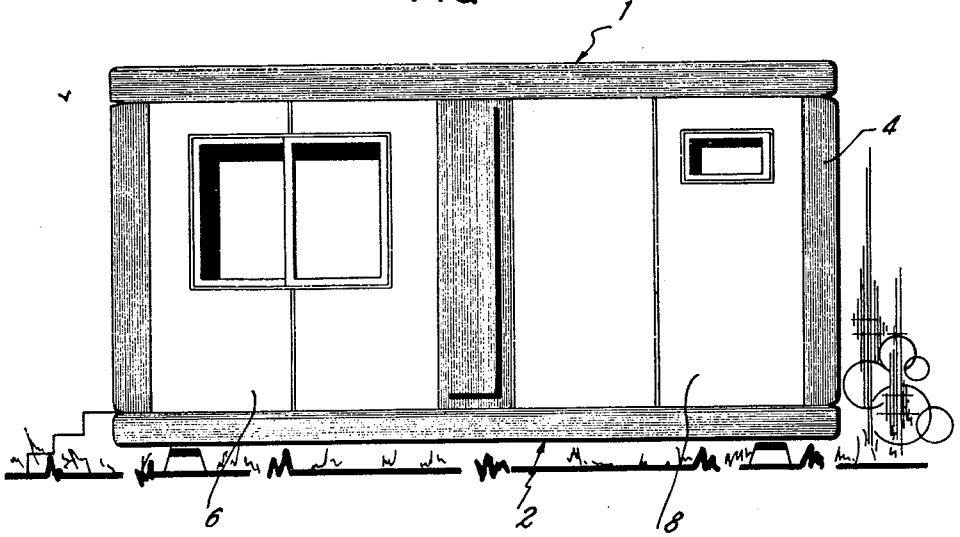
FIG. 4 is an elevational view of another one of the modular buildings.

As appears clearly from FIGS. 1 to 5, the modular building according to the invention is of parallelepipedal shape. Each modular building is constituted by a panel 1 forming the roof and a panel 2 forming the floor interconnected by four metal uprights 3 (FIG. 12) located at the corners of the building. The building also comprises four corner members 4 connecting the floor 2 to the roof 1, in the vicinity of the uprights, and, in the openings created on the long-sides and gable-ends, panels such as solid panels 5, window panels 6, door panels 7 and panels 8 with an upper frame for ventilation.

Figure 14:
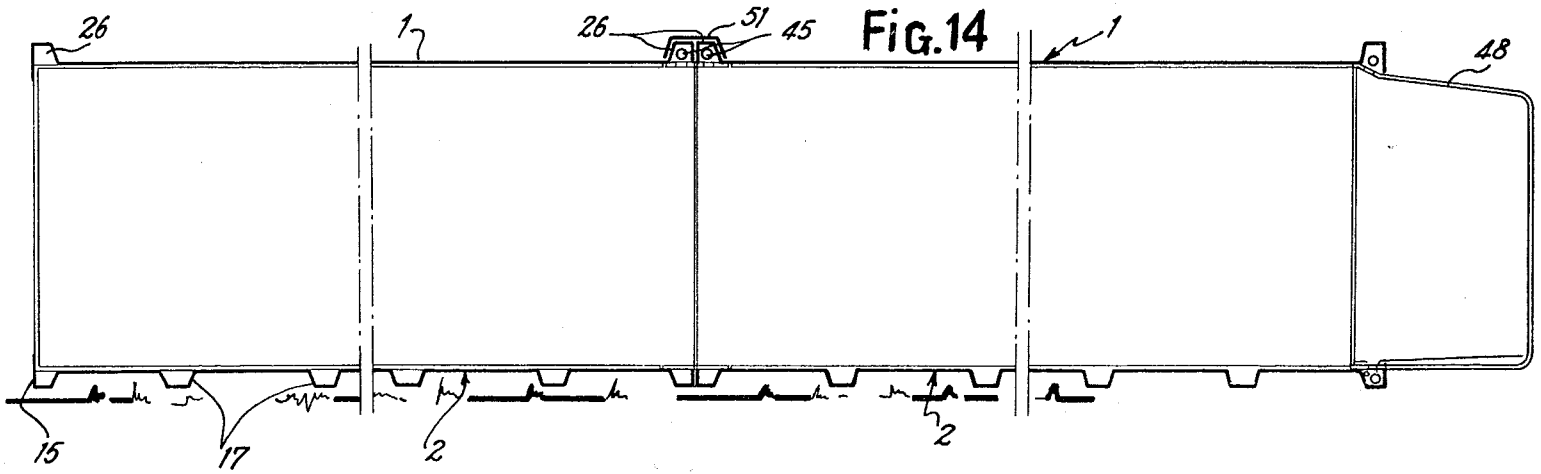
FIG. 14 is a diagrammatic vertical longitudinal sectional view, on the scale of FIGS. 2 to 10, of two modular buildings according to the invention, connected gable-end to gable-end.
Figure 15:
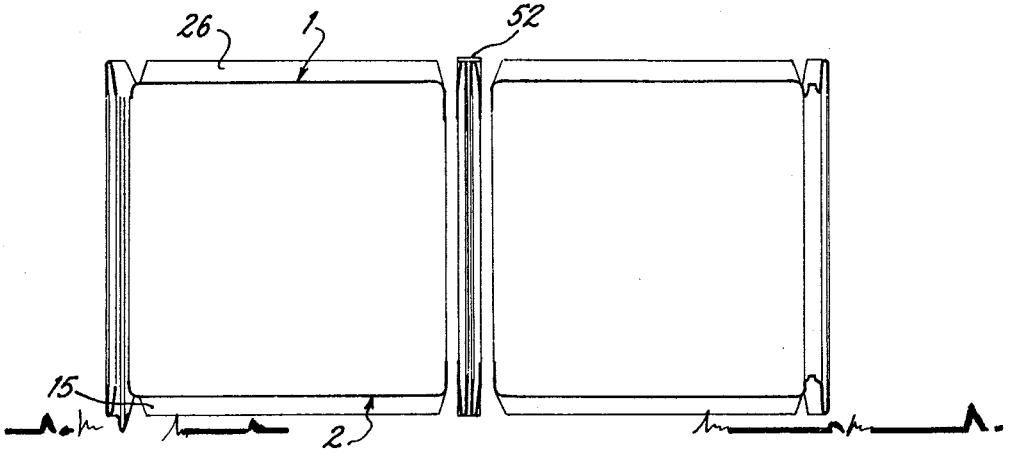
FIG. 15 is a similar cross-sectional view of two modular buildings according to the invention, assembled long-side to long-side.

Modular buildings according to the invention may be interconnected in three dimensions, for example long-side to long-side, gable-end to gable-end and long-side to gable-end. FIGS. 1, 14 and 15 illustrate various methods of juxtaposing the buildings on one level.

Figure 16:
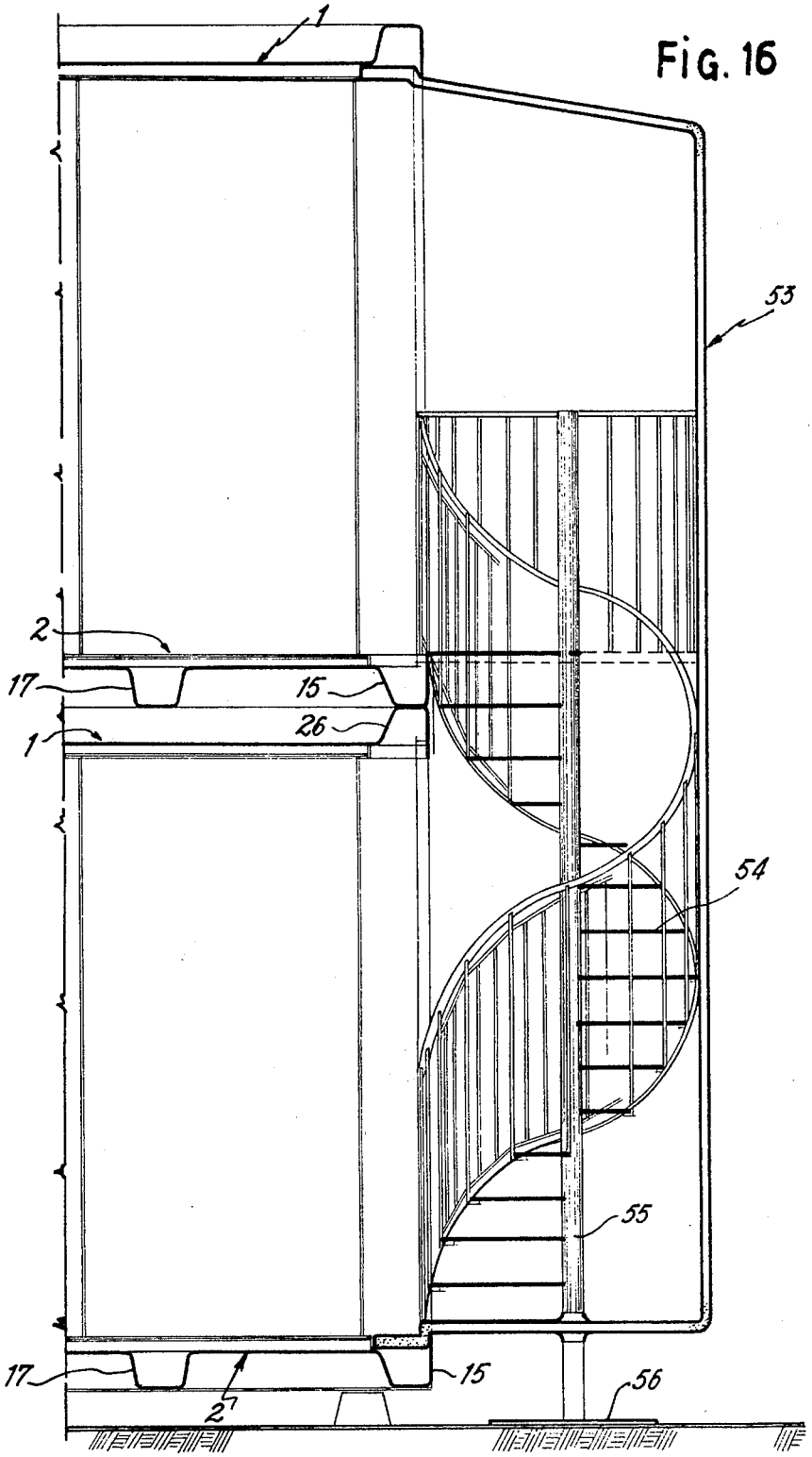
FIG. 16 is a partial vertical sectional view of two superimposed modular buildings according to the invention, with a connected moulded shell.

The modular buildings may also rest one on the other on two levels as illustrated in FIG. 16.

By fitting them in a metal framework, it is also possible to create structures on two or more levels depending on the type of framework.

The modular building according to the invention can be completely dismantled and for its transportation, the roof 1 and floor 2 for a case in which the flat panels, the uprights and all the connecting parts are housed. Siting of the building requires no particular installation, apart from blocks of concrete 9 on which the floor 2 and the connections to the various services rest.

Figure 6:
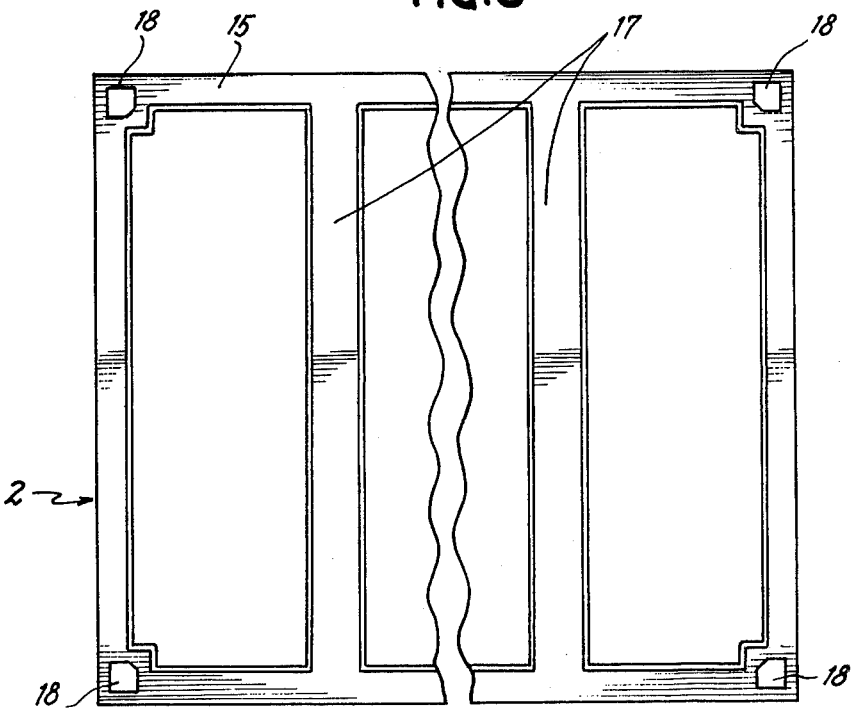
FIG. 6 is a partial plan view of the floor of each building.
Figure 7:
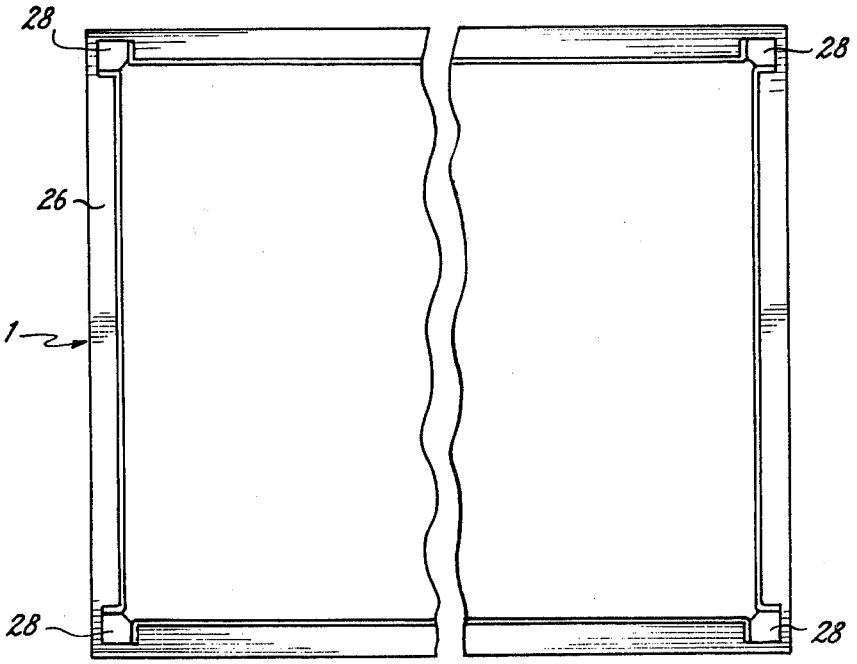
FIg. 7 is a partial plan view of the roof of each building.
Figure 8:
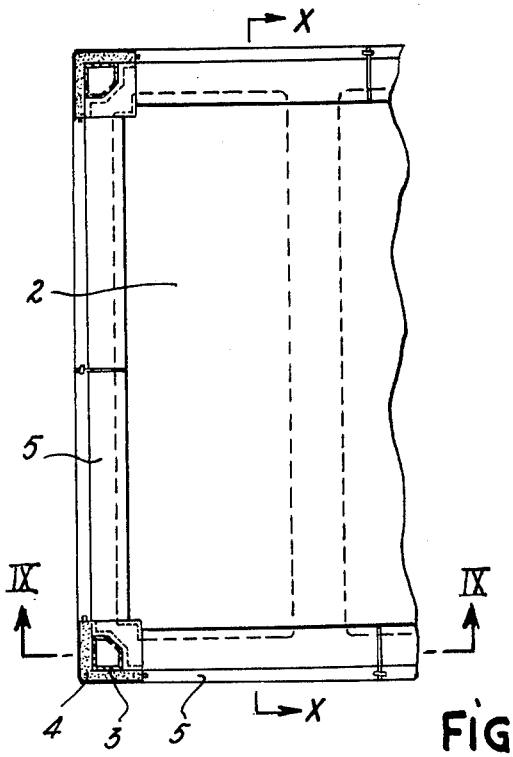
FIG. 8 is a partial horizontal sectional view of the building.
Figure 9:
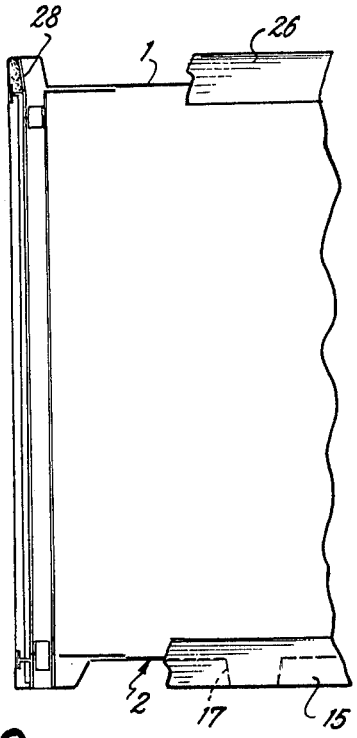
FIG. 9 is a partial vertical sectional view taken on line IX—IX of FIG. 8.
Figure 10:
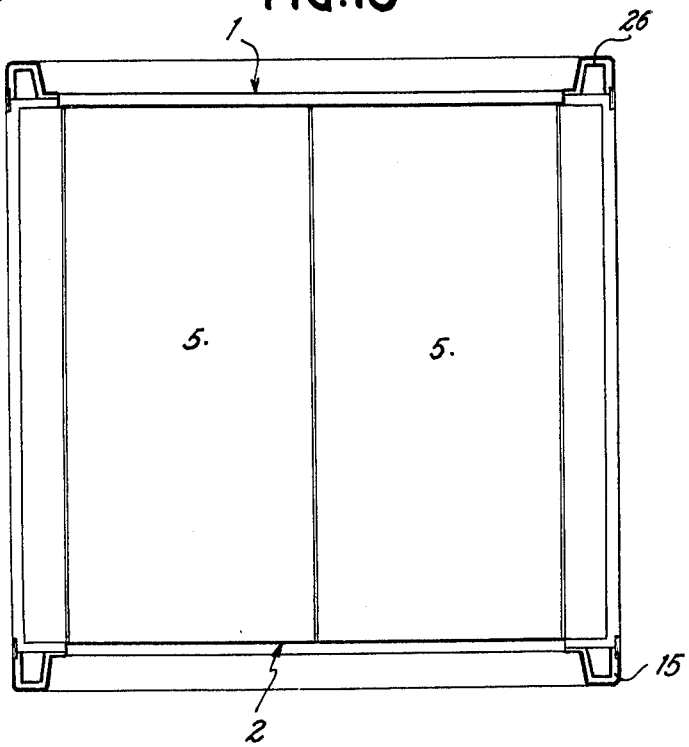
FIG. 10 is a vertical sectional view taken on line X—X of FIG. 8.
Figure 11:
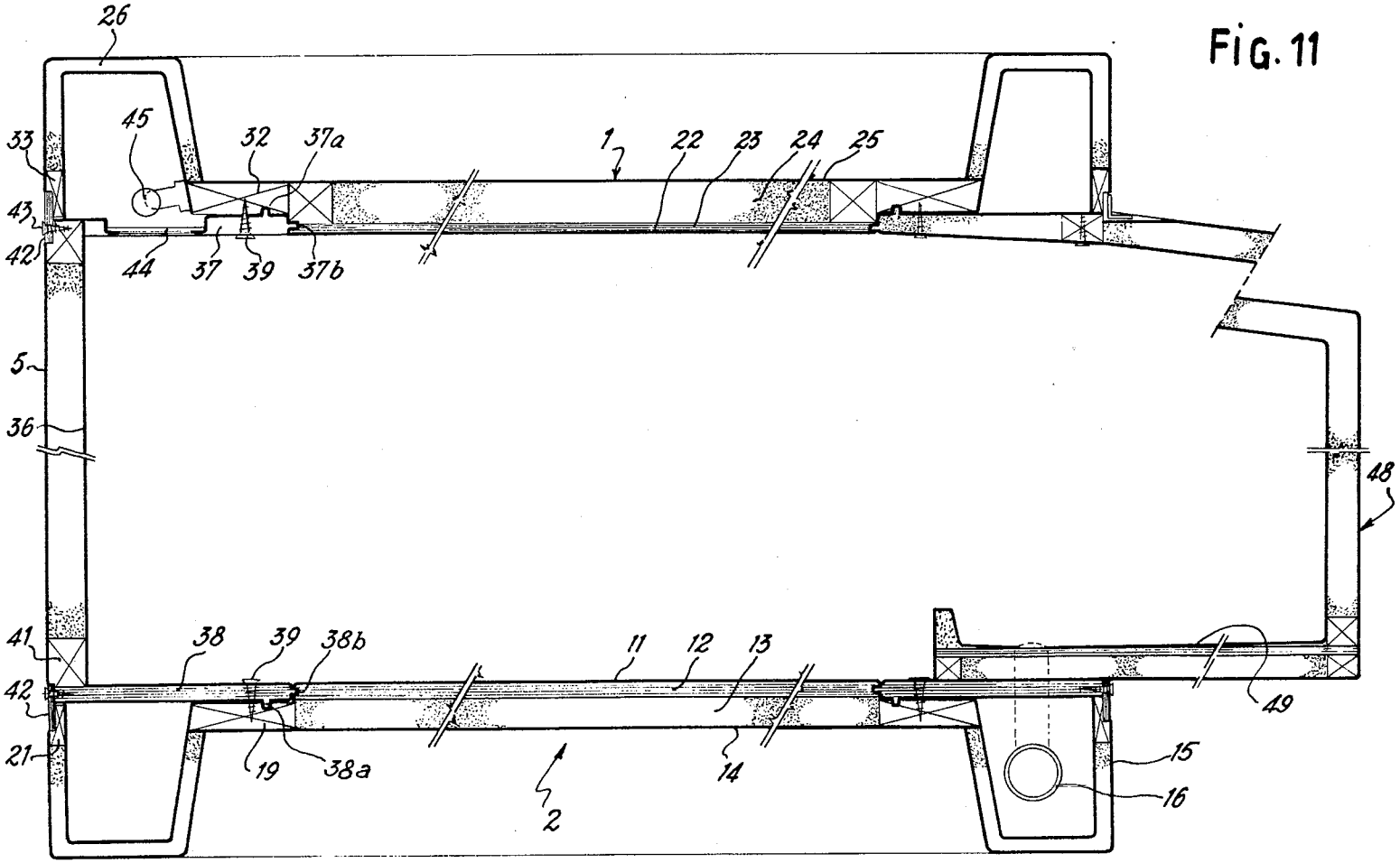
FIG. 11 is a partial vertical sectional view generally similar to FIG. 10 but more detailed and on a larger scale.

The floor 2 of rectangular shape, as it is illustrated in FIG. 6, will now be described in a more detailed manner. This floor is made from several layers (FIG. 11), namely an inner layer 11 of polyester or phenolic stratified material, a layer 12 of plywood, a layer 13 of thermal insulation consisting of foam or of light organic or mineral concrete (polyurethane foam, phenolic complex) and an outer layer 14 of polyester or phenolic stratified material. This panel comprises a peripheral rib 15 extending downwards and in which are housed the pipes for the supply and discharge of liquid, such as a waste water outlet pipe 16 for example (FIG. 11).

The floor 2 also comprises several transverse ribs 17 (FIG. 6) which are moulded to strengthen the floor and reduce its sag under load.

Tubular metal members 18 serving to receive corner uprights 3, as will be seen hereafter, are fixed in the corners by bedding in the panel.

On each side of the peripheral rib 15, the floor also comprises wooden frames intended to ensure positioning of the front panels, namely an inner frame 19 (FIG. 11) and an outer frame 21.

The roof panel 1 also has a sandwich construction, similar to that of the floor 2. It comprises an inner layer 22 of polyester or phenolic stratified material, a layer of plywood 23, a layer 24 of thermal insulation consisting of foam or of light organic or mineral concrete (polyurethane foam, phenolic complex) and an outer layer 25 of polyester or phenolic stratified material. It comprises a peripheral rib 26 similar to rib 21, ensuring strengthening of the roof and facilitating the passage of various electrical circuits.

Fixed by bedding in the corners of the roof 1 are vertical tubular members 27 (FIG. 12) whose upper part is flared and moulded and on each of which is a channel 28 serving to receive the rainwater.

According to one variation, the tubular members 18 and 27 could be moulded in one piece with the floor and roof.

Each channel 28 is extended downwards by a funnel 29 of flexible material which is able to cover a downpipe 31 housed inside the upright 3, or even able to be removed and blocked-up in order to ensure water-tightness.

Like the floor, on each side of the peripheral rib 26, the roof 1 comprises wooden insert frames for ensuring positioning of the panels, namely an inner frame 32 and an outer frame 33 (FIG. 11).

The metal uprights 3, which are placed in the corners of the building, are made from bent sheet metal and have a square section for example truncated along one side. Each upright 3 is connected to a tubular corner member 18 of the floor and a tubular corner member 27 of the roof, by means of bolts 34. Assembly takes place by fitting the members one in the other.

Figures 12, 13:
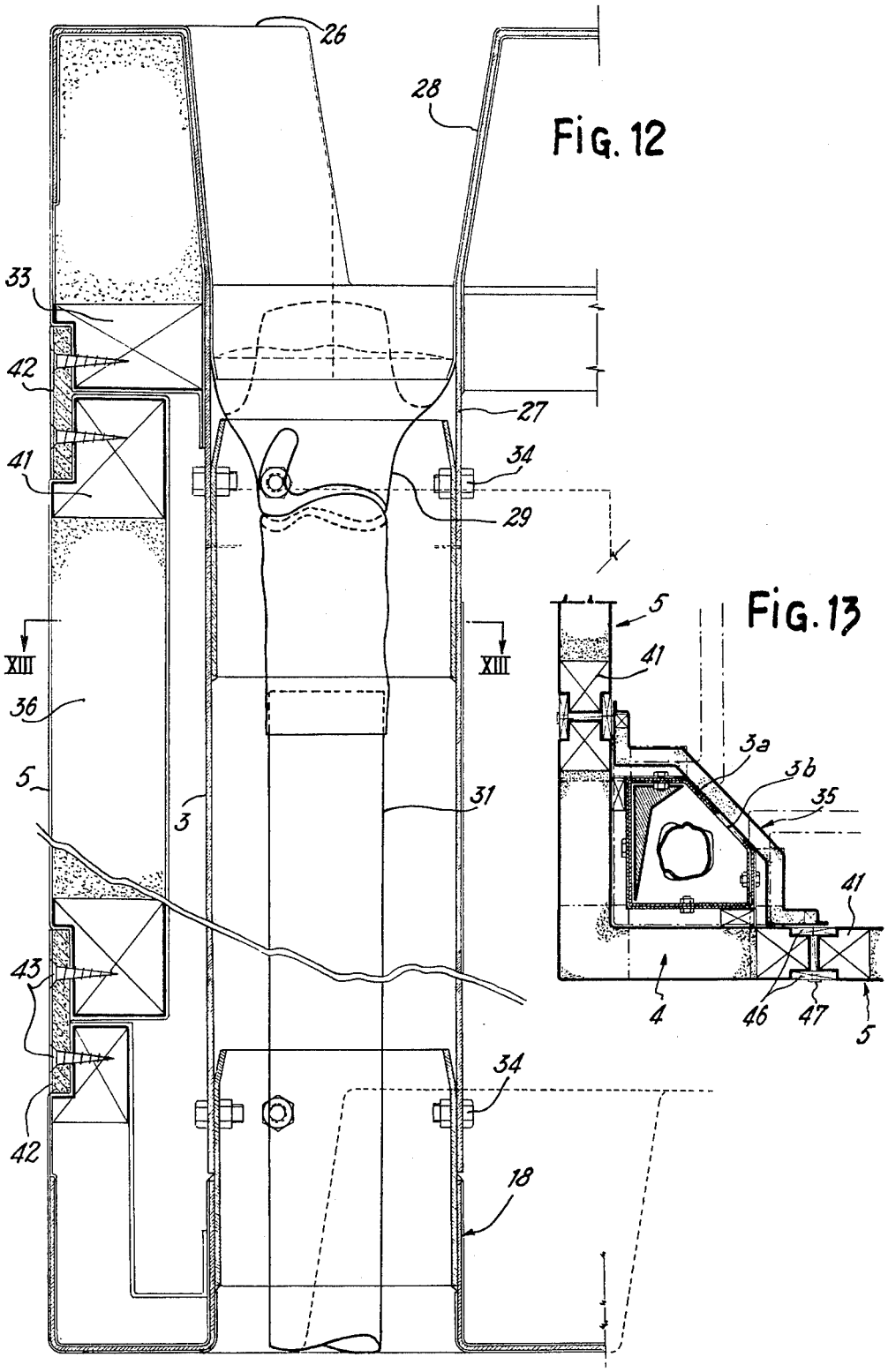
FIG. 12 is a vertical sectional view, on the scale of FIG. 11, of a metal upright located in one corner of the building.
FIG. 13 is a horizontal sectional view taken on line XIII—XIII of FIG. 12.

On its truncated side 3a which is turned towards the inside of the building, each post 3 comprises an opening 3b over its entire height, in order to allow access to the inside of the upright, in particular for the system of pipes. Outer corner members 4 and inner corner members 35 are fixed in the corners to cover the uprights. FIG. 13 shows that each outer corner member 4 has a sandwich construction similar to that of the floor 2 and roof 1. It is fixed to the latter by means of aluminium plates, as will be seen hereafter with reference to the panel. Each inner corner member also has a sandwich construction of the polyester/polyurethane foam type. They are fixed to the floor, roof and outer corner members 4 by wood-screws. As shown for the panel 5 in FIG. 11, the panels which close-off the openings created on the long side and on the gable-end each comprise a vertical part 36 of sandwich construction of the polyester/polyurethane foam or phenolic stratified material or phenolic complex type, which is possibly provided with a door or windows and an upper turned-back horizontal part 37 and a lower turned-back horizontal part 38 ensuring attachment to the structure and closing-off the openings created by the ribs 15 in the floor 2 and the ribs 26 in the structure 1. The upper and lower turned-back parts 37 and 38 are fixed respectively by means of wood-screws 39 to the inner frames 32 of the roof 1 and 19 of the floor 2.

On its upper side, the upper turned-back part 37 comprises a rib **37*a* and on its inner vertical edge a rib 37*b* which fit into respective grooves provided in the inner frame 32 of the roof 1. The same is true for the lower turned-back part 38 which comprises a rib 38*a* on its lower side and a rib 38*b* on its inner vertical edge, these ribs engaging in corresponding grooves respectively provided in the upper side of the inner frame 19 and in the vertical edge of the layer of plywood 12 of the floor 2**.

On its periphery, the vertical part 36 of each panel 5 comprises a wooden frame 41 which is connected to the outer frames 21 of the floor 2 and 33 of the roof 1, by means of aluminium plates 42 and wood-screws 43.

Provided in the upper turned-back part 37 are openings closed-off by transparent plates 44, above which are housed light fittings 45, such as fluorescent tubes, to illuminate the inside of the building.

FIG. 13 shows that the vertical parts of the peripheral frame 41 of the panel are rebated on each side and two opposed cover plates 46 are housed in the rebates, which plates are interconnected by means of screws 47 (FIG. 13) or which are clipped together. illuminated fluorescent As shown in FIG. 11, one of the front panels may be replaced by a connected shell 48 projecting outwards and secured to the roof 1 and floor 2 in the same manner as the panels. This prefabricated shell may comprise sanitary installations such as a shower tray 49 connected to the pipe 16 housed in the underlying peripheral rib 15. This connected shell may be illuninated by a flouorescent tube such as the tube 45 of FIG. 11, housed in the rib 26 and consequently outside the shell 48, so that the latter comprises no electrical supply means.

When modular buildings according to the invention are assembled side-by-side, intermediate flat sandwich members are used, whether or not provided with transparent plates in the ceiling and made of plywood for the floor, to close-off the openings of the peripheral ribs 15 and 26. For the roof, moulded polyester parts are used to ensure the connection and seal between adjacent modules. FIGS. 14 and 15 show sealing covers 51 and 52 covering two adjacent ribs 26.

FIG. 16 illustrates the connection of two superimposed modular buildings. In this case, metal or plastic sleeves are used, which fit in the corner members and ensure the connection of the uprights one to the other. In the construction illustrated in FIG. 16, an outer one-piece connected shell 53 is fixed to the two superimposed modules, by the same means as those used for securing the front panels. Housed inside this shell is a spiral staircase 54 whose vertical pole 55 projects below the shell and is supported on the ground by means of a base plate 56.

Figure 17:
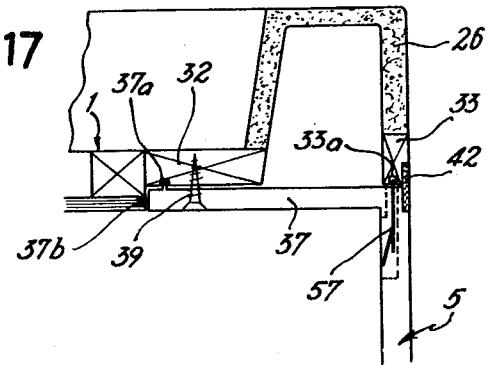
FIGS. 17, 18, 19 are sectional views of certain details.

FIG. 17 shows a variation of the method of mounting the front panels and outer corner members on the structure. The peripheral rib 26 of the roof 1 (and likewise the peripheral rib 15 of the floor which is not shown) comprises a longitudinal groove **33*a* in its outer edge and more particularly on its outer lower face, in fact on that of the outer frame 33. At this point, the front panels 5 and outer corner members are retained on the structure by means of four mortise-locks 57 housed in the panel or corner member and whose bolt engages in the groove 33***a*.

Figure 18:
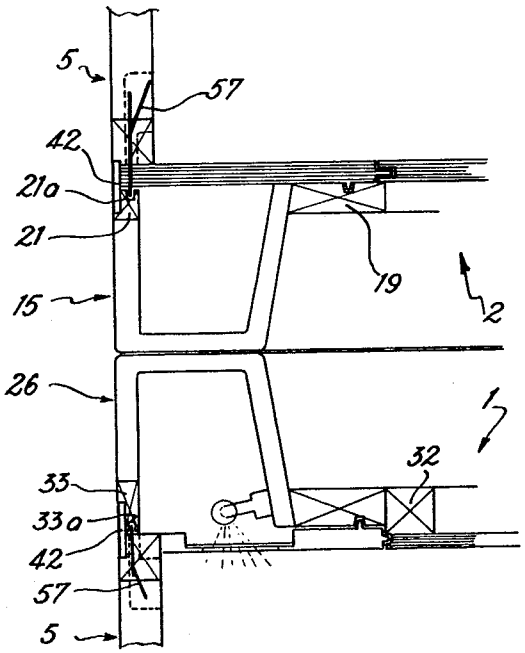

FIG. 18 illustrates this method of assembly in the case of two superimposed modular buildings, the lower peripheral rib 15 of the upper module is supported on the upper peripheral rib 26 of the lower module. In this case, it will be seen that the front panel 5 of the upper module supports a mortise-lock 57 at its lower part, the bolt of which engages in a longitudinal groove 21*a* provided in the upper side of the outer frame 21 of the floor 2.

Figure 19:
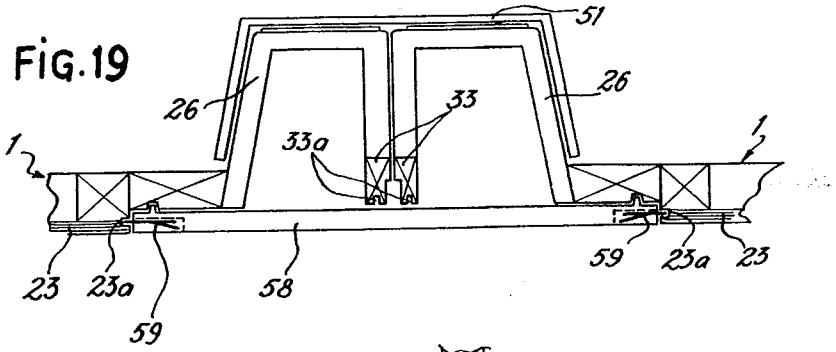

In the case where two modular buildings are attached horizontally FIG. 19 shows that the empty space below the two peripheral ribs 26 of the roofs 1 is closed-off by a horizontal closing plate 58 retained by mortise-locks 59 whose bolts engage in grooves 23*a* provided in the vertical edges of the layers of plywood of the roofs 1.

What is claimed is:

1. A prefabricated modular building of parallelepipedal shape, comprising a roof, a floor, vertical wall sections, and means for interconnecting same, the roof and the floor being each of unitary sandwich construction and formed from molded material, each of the roof and floor comprising; a peripheral rib providing a strengthening member and a housing for services, and as parts of the sandwich construction, means comprising an inner layer of stratified material, a layer of plywood, a layer of insulation comprising a material selected from foam and light concrete, an outer layer of stratified material, and, on each side of the corresponding peripheral rib and for fixing the vertical wall sections, inner wooden frames and outer wooden frames for the roof, and inner wooden frames and outer wooden frames for the floor.

2. A building according to claim 1 in which the inner and outer layers of stratified material are of organic material.

3. A building according to claim 1 in which the inner and outer layers of stratified material are of mineral material.

4. A building according to claim 1, in which the vertical wall sections each comprises a vertical part having a sandwich construction of material selected from polyester stratified material, polyurethane foam, phenolic stratified material and phenolic complex type, and each having an upper horizontal turned-back part and a lower horizontal turned-back part fixed respectively to the wooden frames of the roof and floor and closing-off openings created by the peripheral ribs in the floor and roof.

5. A building according to claim 4, wherein each vertical wall section comprises, on a periphery thereof, a wooden frame which is connected to the outer wooden frames of the floor and the roof, the frame of each section being rebated on each side to house mutually opposed cover plates.

6. A building according to claim 4, in which the upper turned-back part of each vertical wall section has an opening and includes a transparent plate for transmitting light from a light fitting located in the peripheral rib of the roof.

7. A building according to claim 4, in which the upper turned-back part includes, on its upper side, a rib and, on its inner vertical edge, a rib which fits in respective grooves provided in the inner frame of the roof and in which the lower turned-back part includes a rib on its lower side and a rib on its inner vertical edge, the latter ribs engaging in corresponding grooves provided respectively in the upper side of the inner frame and in a vertical edge of the floor.

* * * * *